US011766587B1

(12) United States Patent
Fischer

(10) Patent No.: US 11,766,587 B1
(45) Date of Patent: Sep. 26, 2023

(54) VERSATILE BOARD EXERCISE APPARATUS

(71) Applicant: Matthew Scott Fischer, Helena, MT (US)

(72) Inventor: Matthew Scott Fischer, Helena, MT (US)

( * ) Notice: Subject to any disclaimer, the term of this patent is extended or adjusted under 35 U.S.C. 154(b) by 0 days.

(21) Appl. No.: 17/309,000

(22) Filed: May 6, 2021

(51) Int. Cl.
*A63B 21/00* (2006.01)
*A63B 21/055* (2006.01)

(52) U.S. Cl.
CPC ..... *A63B 21/4047* (2015.10); *A63B 21/0552* (2013.01); *A63B 21/4027* (2015.10); *A63B 2208/0238* (2013.01); *A63B 2208/0252* (2013.01); *A63B 2208/0257* (2013.01)

(58) Field of Classification Search
CPC ..... A63B 21/4047; A63B 21/0552; A63B 21/4027; A63B 2208/0238; A63B 2208/0252; A63B 2208/0257
See application file for complete search history.

(56) References Cited

U.S. PATENT DOCUMENTS 2,764,411 A * 9/1956 Washburn, Jr. ..... A63B 22/16 482/146
2,829,892 A * 4/1958 Ludwig ..... A63B 22/16 482/146
3,389,910 A * 6/1968 Kanzler, Jr. ..... A63B 22/16 482/146
3,806,116 A * 4/1974 Malmberg ..... A63B 22/14 482/147
3,895,794 A * 7/1975 England ..... A63B 22/16 482/146
4,191,371 A * 3/1980 Armer, Jr. ..... A63B 22/18 482/77
4,826,159 A * 5/1989 Hersey ..... A63B 26/003 482/146
6,543,769 B1 * 4/2003 Podoloff ..... A63B 69/0093 273/317.1
6,652,432 B2 * 11/2003 Smith ..... A63B 23/00 482/146
6,916,276 B1 * 7/2005 Robinson ..... A63B 69/0093 482/80
7,134,990 B2 * 11/2006 Wischusen ..... A63B 21/0004 441/74
7,479,097 B2 * 1/2009 Rosborough ..... A63B 22/203 482/146
7,775,952 B1 * 8/2010 Curran ..... A63B 41/00 482/146
7,942,797 B1 * 5/2011 Canton ..... A63B 26/003 482/146
9,387,363 B1 * 7/2016 Polinsky ..... A63B 26/003
10,363,449 B2 * 7/2019 Scott ..... A63B 23/1218
10,881,898 B2 * 1/2021 Petersen ..... A63B 23/1236
11,369,839 B2 * 6/2022 Mrzlak ..... A63B 21/4034
(Continued)

*Primary Examiner* — Andrew S Lo

(57) ABSTRACT

An exercise apparatus system is provided that uses two elongated boards and a pivot member; the configuration allows a person to perform exercise body movements from recumbent, semi-recumbent, supine, and prone positions while receiving biofeedback resistance forces to improve neurological and muscular health. The system restores core stability neuromuscular systems, including improved function of the hip and shoulder joints.

17 Claims, 1 Drawing Sheet

(56) References Cited

U.S. PATENT DOCUMENTS

| | | | | |
|---|---|---|---|---|
| 2006/0211553 | A1* | 9/2006 | Cantor | A63B 21/0004 482/79 |
| 2006/0287173 | A1* | 12/2006 | Guadagno | A63B 69/06 482/142 |
| 2007/0027010 | A1* | 2/2007 | Tsai | A63B 21/0004 482/142 |
| 2017/0095694 | A1* | 4/2017 | Polinsky | A63F 13/211 |
| 2018/0133553 | A1* | 5/2018 | Kramer | A63B 5/00 |
| 2018/0326258 | A1* | 11/2018 | Kordecki | A63B 23/0482 |
| 2019/0160322 | A1* | 5/2019 | McCarthy | A63B 21/4034 |
| 2020/0086172 | A1* | 3/2020 | Tarkington | A63B 21/022 |
| 2021/0361999 | A1* | 11/2021 | Tarkington | A63B 22/16 |

* cited by examiner

VERSATILE BOARD EXERCISE APPARATUS

BACKGROUND OF THE INVENTION

The present invention relates to a simplistic and portable exercise machine that provides specific resistive forces to body motions to improve the health of neurological, muscular, and skeletal systems by activating interstitial mechanoreceptors in the abdominal, gluteal and trunk regions that provide the core strength and stability of the human body. Interstitial mechanoreceptors are specialized neurological sensory receptors imbedded throughout tissues of the body, especially fascia, that receive stimuli from outside the body; particularly external stimuli related to pressure. Secondarily, the present invention activates proprioceptors, specialized neurological receptors that respond to the position and the movement of the body, located primarily in muscles and joints.

Personal exercise equipment for home use is at an all-time high, especially as we transition through the current global pandemic. Recently, there have been simple exercise tools that are designed to activate inherent neuromuscular mechanisms. Although devises that promote stretching and strengthening remain popular, there has also been increasing interest in exercises that activate proprioceptors to strengthen communication channels between muscles and the central nervous system. Exercise equipment trends over the past 20 years have placed increased emphasis on the ability to activate, through proprioceptors and feedback self-awareness, the core muscles that provide the foundation for stability and controlled movement. Most of the exercise products on the market focus on the end result of strengthening core muscles or simply activation of proprioceptors, without regard for the neurological laws of sensory receptors, neurological development, reflexes, and neuroplasticity.

A large percentage of existing products are not efficacious for restoring the neurological motor control patterns that are lost due to various reasons, or never developed in the first place. These motor control issues are common in modem society due to stress, poor neurological development and culture (prolonged sitting, repetitive motion that is biased toward flexion, improper workout and movement habits, etc.). Consequently, there is a high incidence of communication dysfunction between the nervous and muscular systems. In the current era, to address this problem and to attempt to improve core strength, exercise equipment currently on the market uses upright (standing) exercise equipment that often requires advanced neuromuscular coordination exercises, as exhibited on the world wide web at website: https://www.runnersworld.com/training/g33853526/top-balance-boards/ These exercise systems are highly biased toward proprioceptive activation, rather than motor control training and activation with re-education of interstitial mechanoreceptors. This exhibit shows many products requiring a person to exercise "standing balance" on a board that is unstable because it is supported by a rolling cylinder. When used a person stands and balances on the board, attempting to keep the board horizontal, while any imbalance causes the roller to suddenly shift or move to the left or to the right—requiring an immediate balance correction to avoid a fall. These types of rolling action require advanced athletic skills and not appropriate or safe exercise for the majority of the population. It is obvious that they do not activate interstitial mechanoreceptors and subsequent bio-feedback, with the exception of the plantar surface of the feet.

A large sector of our society values well defined and highly visible abdominal muscles. This trend has resulted in numerous exercise machines on the market that claim development of well-defined abdominal muscles, even though current medical research shows functional core muscular stability and visual "six pack" abdominal muscles are not well correlated. Exhibits of these exercise machines are shown at this website: https://yurielkaim.com/abdominal-exercise-machines/

Pilates is an exercise system that has made the greatest impact of addressing core stability by activating mechanoreceptors and proprioceptors. Pilates exercise equipment is well designed for core stability and limb exercise movements and postures to stimulate the nervous system and to promote neurodevelopment, including emphasis on supine positioned work. Yet Pilates equipment often uses a sliding exercise table that less effectively activates core gluteal muscles and functional hip-hinge mobility. Additionally, other than the supine position, Pilates equipment is unable to activate interstitial mechanoreceptors in a planar fashion. Pilates equipment is also very large, requiring significant storage space. The equipment is not portable and is highly expensive. Exhibits of this exercise equipment are shown at this website: https://www.womenshealthmag.com/fitness/g35312538/top-pilates-machines Modern and past exercise apparatus is often insufficient to address the fundamental neurological breakdown that is at the root of injury, accelerated degeneration, and chronic pain. This may be due to the lack of seeing the integrated approach that includes the entirety of the nervous system. The common error is to simply view the nervous system as the brain, spinal cord, and nerves that arise from the spinal cord. In order to address the root causes of pain, injury, and lost performance, it is crucial to expand one's view of the nervous system to include modern science's advanced findings, including: mechanoreceptors, cranial nerves, dysfunctional reflex holding patterns, and dysfunctional neuro pathways. Additionally, and based on modern scientific findings, the sensory interstitial mechanoreceptor refinement appears to be highly overlooked in modern exercise equipment in favor of motor output organization.

Scientific research, particularly of the past 20 years, is replete with evidence that nerve ending receptors, otherwise called mechanoreceptors, populate the tissues of the body, especially the connective tissues by the millions. These receptors convert mechanical energy to electrical energy, for the sole purpose of providing key information to the central nervous system related to pressure and pain. The central nervous system is highly dependent on this feedback development to execute movement properly.

Another key overlooked component is the brainstem and the 12 cranial nerves that exit from this part of the brain. These cranial nerves control vital functions, such as breathing and vision, but are also highly linked to the imbalances and dysfunctions within the body of modern mankind, including the breakdown of core stability, and hip strength. This concept is poorly understood in the orthopedics and exercise professions, primarily due to the bias to view the body as a "machine with parts" rather than the integrated whole that it is, fully inter-connected by fascial connective tissue layers (which are interconnected superficial to deep and also from head to toe). Inside this fascial network are various mechanoreceptors, especially of the interstitial variety, that trip off and communicate to the central nervous system, assuming the tissues of the subject are healthy and functional.

Another key factor is the cranial nerves that exit the brainstem and their tendency to become dysfunctionally imbalanced in the 21st century culture of stress that we live in. This common dysfunction automatically causes deactivation of the gluteal muscles due to psoas (front hip) activation via the neurological law of reciprocal inhibition. Additionally, sustained stress disrupts proper neurological firing patterns of the deep core, especially starting in the pelvis where the core activations begin in a micro-second sequence. As a result of this, the body becomes limited in its designed, functional way to move, thereby finding new ways to achieve a desired movement at whatever cost. We call this new, dysfunctional movement a compensation, or compensatory movement patterns. When the body compensates, it ceases to follow the efficient original program for movement, thus, whatever muscle works aberrantly will develop dysfunctional reflexive holding patterns, or neurological guarding. This makes motor control difficult and ineffective. There will be long-term effect of this emerging neurological firing pattern as new neuro pathways are laid down. The longer this occurs, more effort and quality training will be required to restore it via the principle of neuroplasticity.

It is imperative that an exercise apparatus system be provided to the American people that addresses and solves the root cause of the core breakdown that has led to back, hip, and shoulder breakdown. This is only possible by addressing the forgotten, hidden, and more important aspects of the nervous system and connective tissues. The present invention does this by providing substantial activation with bio-feedback self awareness as the trunk engages with the board in positions that stimulate the most primitive access to neurological development, in ways that effectively help balance brainstem cranial nerve activity. With repeated use, the present invention restores normal nerve pathways to allow movement to once again become anabolic and more youthful. The "teeter totter" effect of the present invention apparatus, in combination with the trunk to board biofeedback, is the ideal way to restore the vital hip hinge to core connection that is the basis for effective human work and movement. When shoulder extension and rotator cuff activation are combined with the hip and core activation, the entire posterior chain of muscles learns to function once again together. In this simple, novel, and innovative approach, a whole new world of rehab and corrective exercise is ready to address the deep roots of the physical movement dysfunctions of our times.

Relating to the present invention, there is not a similar exercise apparatus on the market, nor patented, that functions in the same way as the present invention. Whereas most board and roll exercise apparatus are designed to stimulate proprioception in standing primarily from the senses in the joints, the present invention uses pressure from the board to the trunk to retrain a special kind of mechanoreceptor, while placed in primal postures where neurological learning best occurs. The roll on the present invention is stationary, not rolling, to provide a more primal movement where retraining can occur. The simple, quality directed motions on the present invention trigger access to the "keys" locked within the design of the nervous system for restoring and reprogramming. With the present invention, this is something one can do on their own, without the need for large or ineffective equipment.

Therefore, a new, simple, and safe-to-use, yet portable and low cost exercise system that is designed specifically to activate mechanoreceptors in the core abdominal, trunk, shoulder and gluteal regions that quickly produces core strength and stability in the human body is provided. The nervous system best trains and learns in positions close to the ground, much like a baby develops through precise neurological sequences from the supine and prone positions. Body motions in these ground-contact positions activate interstitial mechanoreceptors throughout the body trunk; therefore, the provided exercise machine allows exercise to take place near the ground, in the prone and supine positions. The present invention described below retrains the body by stimulating and restoring the neurological pathways and neuro-firing patterns that allow the body to move and function using core power extending to the hips and shoulders.

BRIEF SUMMARY OF THE INVENTION

The purpose of this invention is to provide a new exercise machine that produces specialized resistive forces to body motions in order to activate mechanoreceptors essential to core abdominal and gluteal strength and function. The exercise system or apparatus is comprised of two elongated boards with a pivot member sandwiched about midway between them. This configuration allows the upper board to pivot like a playground "teeter totter" requiring exercise force to be applied to pivot the upper board about the pivot member, operably producing upper board rotation across its full pivotal range of rotation or tilting motion. The method for exercise allows a person to rest their torso and head on the upper board while performing exercises from recumbent, semi-recumbent, supine, and prone positions. Generally, the method of exercise uses leg muscles pushing feet, primarily the heels, against the wall or the floor to impart a force into the upper board, producing a pivot motion about the pivot member. Like a "teeter totter" the upper board can tilt and pivot through a full range of motion from the right side down to the right side up.

One objective of the invention is to produce an exercise apparatus system preferably having two elongated boards of approximate equivalent width and length. A first pivot member is then placed between the boards, near their middle. In this configuration the lower board is static, resting on a ground or floor surface and the upper board is nominally positioned as an inclined plane, resting upon the first pivot member and with one end of the upper board resting proximal to the end of the board resting on the floor. Conceptionally this nominal position this is identical to a playground "teeter totter".

It is to be understood throughout this invention that pivot member(s) can be in any size or shape. Some pivot members may be a cylinder shape, other may be an extruded triangular shape. Any pivot member shape is possible without altering the invention. Also, any pivot member can be fastened to any board surface using a load source. For example, a third load source preferably in the form of an elastic band can loop over a board and around the pivot member to secure the first pivot member to the board. In another example, a third load source can be affixed at its ends to a board surface and loop over the pivot member to secure the first pivot member to the board surface. In these examples the first pivot member is operative to produce a lateral pitch axis motion of the upper board. Similarly, in yet another example, a fourth load source can used to secure a second pivot member to the bottom surface of the bottom board. This example the second pivot member is operative to produce a roll axis motion about longitudinal axis of the system.

Another objective of the invention is to activate mechanoreceptors that communicate between the neural and muscular systems, by means of exercise on the machine. While there are a plurality of ways the invented apparatus can be used to achieve this objective there are two exercise motions to achieve the desired exercise results. A description of these exercises follows:

As a first exercise, said person lies semi-recumbent on the upper board surface with base of their torso resting proximal to the first end of the upper board and their head resting proximal to the second end of the upper board. In a nominal first position, the upper board forms an inclined plane with the first end of the upper board in contact with an end of the lower board and being proximal to the floor. From this first position the person uses muscle exercise force, pushing with their feet on the floor, to rotate or tilt the board about the first pivot member while simultaneously raising the base of their torso until the upper board reaches a second position where upper and lower boards are substantially coplanar to each other. For exercise repetitions the person continues to use muscle exercise force to oscillate between the first and second positions.

As a second exercise, said person lies prone on the upper board surface with base of their torso resting proximal to the first end of the upper board and their head resting proximal to the second end of the upper board. In a nominal third position, the upper board rests on the first pivot member and upper and lower boards are approximately coplanar to each other. From this third position the person uses muscle exercise force, pushing with their feet on the floor or the wall, to rotate or tilt the board about the first pivot member while simultaneously lowering the base of their torso until the upper board comes to rest at a fourth position. In the fourth position, the upper board comes to rest in an inclined plane, having pivoted the base of the torso downward and the head upward. For exercise repetitions the person continues to use muscle exercise force to oscillate between the third and fourth positions.

As a third exercise, said person performs a similar motion to the second exercise; however, in the third exercise the person places one knee on the floor to produce the rotation motion of the upper board. In exercise three, the board similarly pivots about the pivot member between positions three and four. For all three described exercises, the torso of the exercise person remains in contact with the upper board surface and gravity and the pivot member position or location (as affecting moment forces required to pivot the board) provides resistive force that must be overcome using muscle exercise force.

It is yet another objective of the invention to provide a method for exercise, to specifically activate body core mechanoreceptors using and apparatus comprising two elongated boards with a pivot member sandwiched about midway between them: the two board configuration allows the upper board to pivot like a playground "teeter totter" requiring exercise force to be applied to pivot the upper board across its full pivotal range of motion. The methods for exercise include the described first, second, and third exercises.

It is yet another objective of the invention to produce an external load source vibrator with said vibrator producing vibration energy. Vibrators and percussors are commonly used in massage, exercise, and physical therapy. In the preferred embodiment a vibrator is integrated into the first pivot member; however other vibrator locations are possible, such as affixment to the underside of the upper board.

It is yet another objective of the invention to produce an external load source acoustic, or musical, vibrational energy. Acoustic frequency vibration has been developed over the past 20 years to convert acoustic frequency to mechanical vibration via a transducer. In the preferred embodiment, the transducers are affixed to the underside of the upper board. However, other transducer locations are possible, including within the first pivot member. This is another form of a vibrator.

It is yet another objective of the invention to produce an external load source pulsed electro-magnetic field (PEMF). PEMF is a modality of increasing popularity in the recent years, used by physical therapists, chiropractors, and medical doctors, but also widely available to the public. In the preferred embodiment, the PEMF devise is affixed to the underside of the upper board. This is yet another form of a vibrator.

As the person gains strength using the present invention, however, more resistive force in needed to avoid high numbers of exercise motion repetitions. Therefore, it is yet another object of the invention to add an adjustable resistance force to further oppose muscle exercise forces. To achieve this in the preferred embodiment, a first load source in the fonn of an elastic chord or band is placed around the right-side distal ends of the two boards. The first load source urges the right-side distal ends toward each other, and this opposing resistance force increases the muscle exercise work force required to pivot the upper board. Normally the described first load source is used when the person conducts the described first exercise.

In a similar manner and yet another preferred embodiment of the invention, a second load source is banded around the left-side distal ends of the boards to nominally couple them together. In this configuration the second load source nominally urges the left-side distal board ends toward each to other and this opposing resistance force increases the muscle exercise work force required to pivot the upper board. Normally the described second load source is used when the person conducts either of the described second or third exercises.

Broadly described, this invention describes an exercise apparatus system for a person that has two elongated boards and a pivot member. The first board having an elongated shape and having first and second surfaces, and first and second ends. The system also has a first pivot member that is located about midway between the first and second ends of the first; said first pivot member is operative to produce a lateral pitch axis for said first board, said lateral pitch axis being orthogonal to the longitudinal axis of said first board. The system also has a second board having a similar elongated shape with third and fourth surface and third and fourth ends.

The apparatus has first board substantially overlapping said second board, with second and third surface facing each other. The fourth surface is nominally static and in contact with the floor. In this configuration, the first and third end of the first and second boards nominally oppose each other and the second and fourth ends of first and second boards also oppose each other. This allows the first surface is operative support the torso of the person exercising from at least one from the list of recumbent, semi-recumbent, supine, and prone positions.

Further, the apparatus first pivot member contacts the second and said third surfaces and is sandwiched about mid-distance between the first and second board ends of the first board and about mid-distance between third and fourth board ends of the second board.

In use the exercise apparatus system, allows the first board to pivot through any range of motion from having the first and third ends proximally together while said ends second and fourth ends are distally apart, to having the first and third ends distally apart while the second and fourth ends are proximally together.

Further in use, the system provides a plurality of exercise motions including: a first use, where the person lies semi-recumbent on the first surface of the first board with base of torso proximal to the first end and head proximal to the second end, then using muscles with feet pushing on the floor, said person oscillates said first board between a first position and a second position. In the first position the first board forms an inclined plane relative to the second board, with the first and third ends proximal to each other and the second and forth ends distal from each other. In the second position the first board is substantially coplanar with said second board. To reach the second position, the first board pivots about the pivot member to reach said second position.

In another exercise, from a prone position the person oscillates the first board between a third position and a fourth position. In the third position, the first board forms an inclined plane relative to said second board, with the first and third ends distal to each other and said second and forth ends proximal from each other. In the fourth position, the first board is substantially coplanar with said second board, said board pivots about said pivot member to reach said second position. These exercises are operative to improve at least one of neurological and muscular health.

To add resistive force to the exercise motion, a first load source is banded around the first end of the first board and the third end of the second board to nominally couple these ends proximal to each other and the first load source operatively urges these ends together. Then in use the person while resting in semi-recumbent position on the first surface applies muscle force to oppose the first load force and when the muscle force exceeds the first load source force the first and third board ends progressively decouple and the first board operably undergoes said lateral pitch motion as the first board pivots about the first pivot member.

Likewise to add resistive force to the exercise motion, a second load source is banded around the second end of the first board and the fourth end of the second board to nominally couple the these ends proximal to each other and the second load source operatively urges these ends together. Then in use the person while resting in semi-recumbent position on the first surface applies muscle force to oppose the second load force and when the muscle force exceeds the second load source force the third and fourth board ends progressively decouple and the first board operably undergoes said lateral pitch motion as the first board pivots about the first pivot member.

In an alternate embodiment, the system has a second pivot member located on the fourth surface of the second board and is operative to provide roll axis motion about longitudinal axis of said system. This motion induces instability to improve the exercise experience since exercise work force must be used to resist unbalanced longitudinal roll motions produced by the optional second pivot member.

Simplicity conceptualized the system for exercise comprises of two elongated boards with a pivot member sandwiched about midway between them to produce a playground "teeter totter" configuration to allow exercise force to be applied to pivot the upper board about the pivot member. While doing exercise the system offers a plurality of exercise motions while the torso of a person rests on said upper board when performing exercise work from in any one from the list of recumbent, semi-recumbent, supine, and prone positions. Optionally first and second load sources can be looped around the free ends of the boards to induce resistive loads to pivot motions and to improve the exercise experience.

A method of exercise is also provided for the apparatus. The method involves the person applying muscle forces to pivot the upper board to overcome any from the list of the following resistive forces: gravity, moment forces resulting from pivot member positions, first load source, and second load source.

Further aspects of the invention will become apparent from consideration of the drawings and the ensuing detailed description of preferred embodiments of the invention. A person skilled in the art will realize that other embodiments of the invention are possible and that the details of the invention can be modified in a number of respects, all without departing from the disclosed concepts: Thus, the following drawings and description are to be regarded as illustrative in nature and not restrictive.

BRIEF DESCRIPTION OF THE DRAWINGS

The features of the invention will be better understood by reference to the accompanying drawings which illustrate presently preferred embodiments of the invention. In the drawings.

Figure 1:
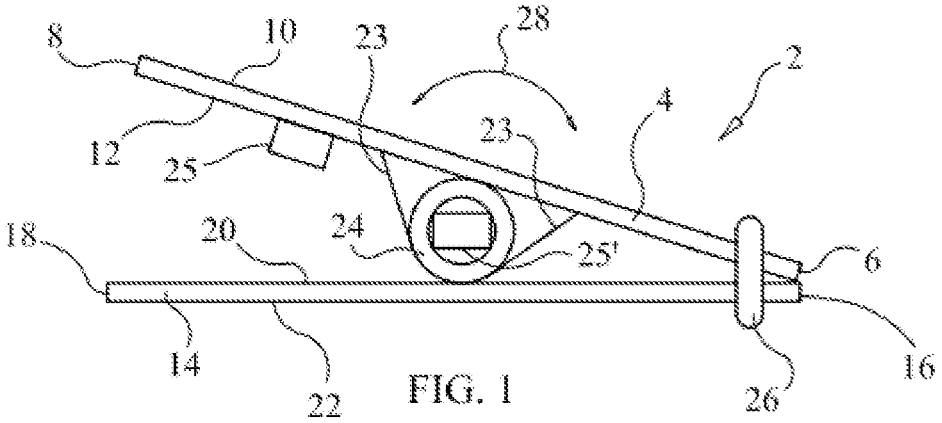
FIG. 1 presents a right side view of the exercise equipment in a first position.

The following reference numerals are used to indicate the parts and environment of the invention on the drawings:

2 exercise equipment, exercise apparatus, machine, system;
4 first board, upper board, first elongated member;
6 first end of first board, right-side end of first board, first end;
8 second end of first board, left-side end of first board, second end;
10 top surface of first board, upper surface, first surface;
12 bottom surface of first board, lower surface, second surface;
14 second board, lower board, second elongated member;
16 third end of second board, right-side end of second board, third end;
18 fourth end of second board, left-side end of second board, second end;
20 top surface of second board, top surface, third surface;
23 third load source, load source, elastic band, elastic cord
22 bottom surface of second board, bottom surface, fourth surface;
25, 25' load source vibrator, vibrator, vibration source
24 first pivot member;
26 first load source, first elastic band, first elastic chord;
28 first pivot motion; first pivot axis, first lateral axis, first lateral axis pitch
direction; lateral pitch axis that is orthogonal to the longitudinal pitch axis;
30 second load source, second elastic band, second elastic chord;
32 second pivot member;
34 second pivot motion; second pivot axis, second longitudinal axis, second longitudinal pitch direction; longitudinal pitch axis that is orthogonal to the lateral pitch axis;

35 fourth load source, load source, elastic band, elastic cord

DETAILED DESCRIPTION OF THE INVENTION

The following description of the preferred embodiments of the invention is merely exemplary in nature and is in no way intended to limit the invention, its application, or uses.

Referring to FIG. 1, a sketch showing the exercise apparatus system 2 comprising a first board 4, with first board 4 having a first end 6, a second end 8, a first surface 10, and a second surface 12. System 2 further comprises a second board 14, with second board 14 having a third end 16, a fourth end 18, a third surface 20, and a fourth surface 22. System 2 further comprises a first pivot member 2 that is located about mid-distance between first board 4 and second board 14; first pivot member 2 is operative to allow board 4 to travel full range of first pivot motion 28. The system 2 is depicted in a first position configuration, with first board 4 in an inclined plane position. From the first position, board 4 can pivot in a first pivot motion 28 about first pivot member 24. Pivot motion 28 depicted is oscillatory, allowing first pivot motion to be in either rotational direction to accommodate exercise motion repetitions. Fourth surface 22 of board 14 remains nominally horizontal and statically in contact with a floor surface (floor surface not shown for clarity).

Load source 23 is an elastic member or band attached to first board 4 and wrapped over first pivot member 24, allowing load source 23 to be operative to secure member 24 to surface second surface 12 of first board 4. A first vibratory member 25 is attached to second surface 12 of first board 4 or alternately a second vibratory member 25' is integrated into first pivot member 24, allowing either vibrator to operatively function as a vibrator source that imparts vibration energy through first board 4. This configuration allows a person with torso resting on first surface 10 of first board 4 to experience vibration energy from vibratory members 25 or 25'.

Still referring to FIG. 1, in use a person (not show for clarity) uses system 2 by lying semi-recumbent on first board surface 10 with base of their torso proximal to the first end 6 of first board 4 and their head proximal to the second end 8 of first board 4. Then the person commences the previously described first exercise.

Still referring to FIG. 1, to provide additional resistive exercise muscle work force a first load source 26 is shown encompassed around the distal ends 6 and 16 of boards 4 and 14; respectively. Load source 26 is operative to urge ends 6 and 16 towards each other, further resisting exercise muscle work force required to tilt or pivot board 4 through pivot motion 28. Load source 26 is considered optional to the function of system 2 and only serves to augment the exercise experience.

Figure 2:
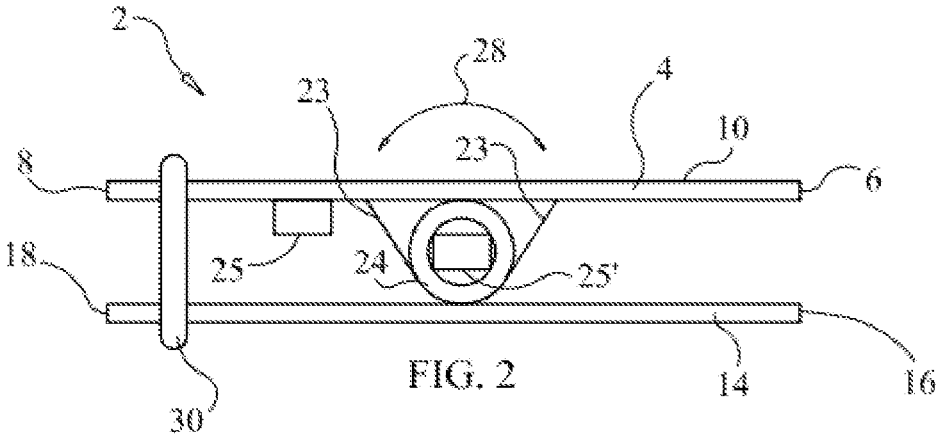
FIG. 2 presents a right side view of the exercise equipment in a third position.

Referring to FIG. 2, a sketch showing the exercise apparatus system 2 is depicted in a third position configuration, with first board 4 substantially coplanar to second board 14. Pivot motion 28 is depicted is oscillatory, allowing first pivot motion to be in either rotational direction to accommodate exercise motion repetitions. In use a person (not show for clarity) uses system 2 by lying prone on first board 4 surface 10 with base of their torso proximal to the first end 6 of first board 4 and their head proximal to the second end 8 of first board 4. Then the person commences the previously described second or third exercises.

Still referring to FIG. 2, to provide additional resistive exercise muscle work force a second load source 30 is shown encompassed around the distal ends 8 and 18 of boards 4 and 14; respectively. Load source 30 is operative to urge ends 8 and 18 towards each other, further resisting exercise muscle work force required to tilt or pivot board 4 through pivot motion 28. Load source 30 is considered optional to the function of system 2 and only serves to augment the exercise experience.

Figure 3:
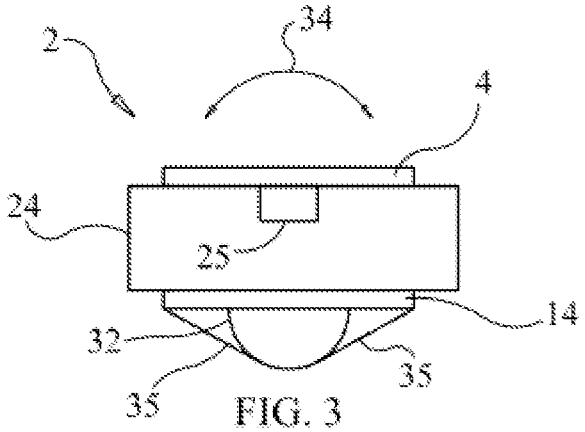
FIG. 3 presents a front end view of the exercise equipment, showing location of second pivot member. (Exercise person not shown in FIGS. 1 to 3 for purposes of clarity).

Referring to FIG. 3, a sketch showing the exercise apparatus system 2 comprising a first pivot member 24 sandwich between first board 4 and second board 14. Second pivot member 32 sandwich between second board 14 and floor surface (not shown for clarity). When in use, first pivot member 24 is operative to produce first pivot motion 28 (shown in FIGS. 1 and 2) and second pivot member 32 is operative to produce second pivot motion 34. Pivot member 32 is considered optional to the function of system 2 and only serves to augment the exercise experience. Further in use, when the person exercises on system 2, oscillating in motions 28 and 34 about pivot members 24 and 32; respectively. When a person exercises from the semi-recumbent and prone kinematic positions, through the range of pivot motions 28 and 34, they engage proprioceptors that communicate between neurological and muscular systems to strengthen and improve the operating function of core-body abdominal and gluteal muscles.

Load source 35 is an elastic member or band attached to second board 14 and wrapped over second pivot member 32, allowing load source 35 to be operative to secure member 32 to second board 14.

A person having ordinary skill in the art would understand that the invention has applications for human health. This invention could be incorporated into other machines without limitation. Further, provided these teachings many variations of the invention will occur to those skilled in the art. Some variations include different body positions while exercising while other variations increase the exercise challenge by adding load sources to increase exercise muscle resistance forces or by adding second pivot member; however, other variations are allowed without limit. All such variations are intended to be within the scope and spirit of the invention. Further still, although some embodiments are shown to include certain features, the applicant specifically contemplates that any feature disclosed herein may be used together or in combination with any other feature on any embodiment of the invention. It is also contemplated that any feature may be specifically excluded from any embodiment of the invention.

What is claimed is:

1. A system for exercise comprising apparatus equipment including of two elongated boards, said boards comprising an upper board and a lower board each having opposing first and second board end, with a pivot member sandwiched about midway between said upper and lower boards and a load source installed on the upper and lower boards proximal to either the first board ends or the second board ends, said load source is an elastic member, said load source operative to urge either of the first board ends or the second board ends in contact toward each other, wherein;

said two boards, pivot member, and load source system are configured to require exercise work to overcome said load source by pitch motion of the upper board, causing said upper board to pivot like a playground "teeter totter";

said upper board configured to provide a platform to perform exercise work, said platform configured to support a torso of a person performing said pitch pivot motion exercise by overcoming said load source to oscillate said upper board about in said pitch motion;

said platform configured for exercise to be performed in any one of the list of recumbent, semi-recumbent, supine, and prone positions.

2. The system of claim 1 wherein, when increased exercise work force are applied to said upper board to overcome;

a first load source, said first load source operatively couples right-side-ends of said elongated boards nominally together, said first load source urging said right-side-ends together, and when exercise force exceeds said first load source force, said upper board pivots about said pivot member from an inclined plane position to a horizontal plane position.

3. The system of claim 1 wherein, increased exercise work forces are applied to said upper board to overcome;

a second load source, said second load source operatively couples left-side-ends of said elongated boards nominally together, said second load source urging said left-side-ends together, and when exercise force exceeds said second load source, said upper board pivots about said pivot member from a horizontal plane position to an inclined plane position.

4. The system of claim 1, said system further comprises:

a vibrator is configured to transfer vibration forces through said upper board to the person; said vibrator is installed at any one of the locations from the following list;

said vibrator is integrated into or affixed to said pivot member; and said vibrator is affixed to said upper board;

wherein, said vibrator is configured to transfer vibration forces through said upper board to said torso of said person.

5. The system of claim 1, wherein said pivot member is at least one from the list of: a cylinder and a triangle.

6. An exercise apparatus system for a person with said system having two elongated boards and pivot member, said exercise system comprising:

a first board, said first board having an elongated shape and having;

a first surface;

a second surface;

a first end; and a second end;

a second board, said second board having an elongated shape and having;

a third surface;

a fourth surface;

a third end;

a fourth end;

a first pivot member, said first pivot member is operative to functionally allow pitch rotation of said first board about said first pivot member;

one of:

a first load source, said first load source is an elastic band operative to urge said first and third ends in contact toward each other; or a second load source, said second load source is an elastic band operative to urge said second and fourth ends in contact toward each other; and wherein, said first board substantially overlaps said second board;

said second and third surfaces face each other;

said fourth surface is nominally static and in contact with a floor surface;

said first end nominally opposes said third end and said second end nominally opposes said fourth end;

said first surface is configured to nominally support the torso of said person resting on said first surface while in at least one from the list of recumbent, semi-recumbent, supine, and prone positions;

said first pivot member is sandwiched about midway between said first and said second boards and;

said first pivot member is in contact with said second and said third surfaces.

7. The system of claim 6, wherein said first load source is banded around said first end of said first board and said third end of said second board, said first load source operatively urges said first and third ends in contact toward each other;

when in use said system is configured for a person resting in semi-recumbent position on said first surface to apply muscle force, said muscle force opposes said first load force and as said muscle force exceeds said first load source force said first and third ends progressively decouple and said first board operably undergoes said pitch motion as said first board pivots about said first pivot member.

8. The system of claim 6, wherein said second load source is banded around said second end of said first board and said fourth end of said second board, said second load source operatively urges said second and fourth ends in contact toward each other;

when in use said system is configured for a person resting in prone position on said first surface applies muscle force, said muscle force opposes said second load source force and as said muscle force exceeds said second load source said second and fourth ends progressively decouple and said first board operably undergoes said lateral pitch motion as said first board pivots about said first pivot member.

9. The system of claim 6, further comprising a third load source, said third load source is an elastic band, said third load source is operative to fasten said first pivot member to at least one of: said second surface of said first board, and said third surface of said second board.

10. The system of claim 6, further comprising a second pivot member, said second pivot member located on said fourth surface of said second board, said second pivot member operative to provide roll axis motion about longitudinal axis of said system.

11. The system of claim 6, further includes;

a second pivot member, said second pivot member located on said fourth surface of said second board, said second pivot member operative to provide roll axis motion about longitudinal axis of said system, and a fourth load source, said fourth load source operative to fasten said second pivot member to said fourth surface of said second board.

12. The system of claim 6, further includes;

a second pivot member, said second pivot member located on said fourth surface of said second board, said second pivot member operative to provide roll axis motion about longitudinal axis of said system, wherein, said system is configured for a person to perform exercise work;

the said exercise work requires resisting unbalanced roll motions produced by said second pivot member and causing said system to nominally be unstable, when said second pivot member is installed.

13. The system of claim 6, wherein, a vibrator is operative to transfer vibration forces through said first board; said vibrator is located at least one of the locations from the following list;

said vibrator is integrated into or affixed to said first pivot member;

said vibrator is affixed to said second surface of said first board;

and wherein, said vibration is configured to be imparted upon person performing exercise.

14. The system of claim 6, wherein said first pivot member is at least one from the list of: a cylinder and a triangle.

15. A method for exercise comprising the structure of:

a first board, said first board having an elongated shape and having;

a first surface;

a second surface;

a first end; and a second end;

a second board having an elongated shape and having;

a third surface;

a fourth surface;

a third end;

a fourth end;

a first pivot member, said first pivot member is operative to functionally allow pitch rotation of said first board about said first pivot member like a playground "teeter totter";

and one of;

a first load source, said first load source is an elastic band operative to urge said first and third ends in contact toward each other; or a second load source, said second load source is an elastic band operative to urge said second and fourth ends in contact toward each other; and wherein, said method configured to provide a plurality of exercise motions for a person from any of the following list of exercises;

a first exercise, said first exercise is performed using the configuration of a person lying semi-recumbent on said first surface of said first board with base of torso proximal to said first end and head proximal to said second end, then using muscles with feet pushing on the floor to overcome first load source, said person oscillates said first board through said pitch motion, between any one of the following positions;

in step one a first position is achieved, in said first position said first board forms an inclined plane relative to said second board, with said first and third ends proximal to each other and said second and forth ends distal from each other;

in step two a second position is achieved, in said second position first board is substantially coplanar with said second board, and in;

a second exercise, said second exercise is performed using the configuration of a person lying prone on said first surface of said first board with base of torso proximal to said first end and head proximal to said second end, then using leg muscles and feet to overcome said second load source, said person oscillates said first board through said pitch motion, between any one of the following positions;

in step three a third position is achieved, in said third position said first board forms an inclined plane relative to said second board, with said first and third ends distal to each other and said second and forth ends proximal from each other;

in step four a fourth position is achieved, in said second position first board is substantially coplanar with said second board.

16. The method of claim 15 operably configured to require increased exercise work forces to be applied to said first board as an exercise step five to overcome;

a first load source, said first load source operatively couples right-side-ends of said elongated boards nominally together and when exercise force exceeds said first load source said said first board pivots from an inclined plane position to a horizontal plane position.

17. The method of claim 15 operably configured to require increased exercise work forces to be applied to said first board as an exercise step six to overcome;

a second load source, said second load source operatively couples left-side-ends of said elongated boards nominally together and when exercise force exceeds said second load source said said first board pivots from a horizontal plane position to an inclined plane position.

* * * * *